US009221661B2

(12) United States Patent
Mimbu et al.

(10) Patent No.: US 9,221,661 B2
(45) Date of Patent: Dec. 29, 2015

(54) PRESSURE ADJUSTER, FIXING DEVICE, AND IMAGE FORMING APPARATUS

(71) Applicants: Ryuuichi Mimbu, Kanagawa (JP); Takayuki Seki, Kanagawa (JP); Hiroshi Yoshinaga, Chiba (JP); Yuji Arai, Kanagawa (JP); Yutaka Ikebuchi, Kanagawa (JP); Yoshiki Yamaguchi, Kanagawa (JP); Kazuya Saito, Kanagawa (JP); Shuutaroh Yuasa, Kanagawa (JP); Shuntaro Tamaki, Kanagawa (JP); Toshihiko Shimokawa, Kanagawa (JP); Naoki Iwaya, Tokyo (JP)

(72) Inventors: Ryuuichi Mimbu, Kanagawa (JP); Takayuki Seki, Kanagawa (JP); Hiroshi Yoshinaga, Chiba (JP); Yuji Arai, Kanagawa (JP); Yutaka Ikebuchi, Kanagawa (JP); Yoshiki Yamaguchi, Kanagawa (JP); Kazuya Saito, Kanagawa (JP); Shuutaroh Yuasa, Kanagawa (JP); Shuntaro Tamaki, Kanagawa (JP); Toshihiko Shimokawa, Kanagawa (JP); Naoki Iwaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/193,273

(22) Filed: Feb. 28, 2014

(65) Prior Publication Data

US 2014/0270875 A1 Sep. 18, 2014

(30) Foreign Application Priority Data

Mar. 15, 2013 (JP) ..... 2013-053789
May 22, 2013 (JP) ..... 2013-107933

(51) Int. Cl.
*G03G 15/20* (2006.01)
*B66F 19/00* (2006.01)

(52) U.S. Cl.
CPC ..... *B66F 19/00* (2013.01); *G03G 15/2035* (2013.01); *G03G 15/2067* (2013.01); *G03G 15/2071* (2013.01); *G03G 2215/2035* (2013.01)

(58) Field of Classification Search
CPC ..... G03G 15/2035; G03G 15/2067; G03G 15/2071; B66F 6/00
USPC ..... 399/332
See application file for complete search history.

(56) References Cited

U.S. PATENT DOCUMENTS

| | | | | |
|---|---|---|---|---|
| 4,536,076 | A * | 8/1985 | Bickerstaff et al. | 399/325 |
| 5,337,134 | A * | 8/1994 | Sato et al. | 399/124 |
| 2007/0292175 | A1 | 12/2007 | Shinshi | |
| 2009/0022516 | A1 * | 1/2009 | Ohta et al. | 399/126 |

(Continued)

FOREIGN PATENT DOCUMENTS

| | | | |
|---|---|---|---|
| JP | 2007024950 | A * | 2/2007 |
| JP | 2007-334205 | | 12/2007 |
| JP | 2009-139682 | | 6/2009 |

OTHER PUBLICATIONS

U.S. Appl. No. 14/010,823, filed Aug. 27, 2013.

(Continued)

*Primary Examiner* — David Gray
*Assistant Examiner* — Laura Roth
(74) *Attorney, Agent, or Firm* — Harness, Dickey & Pierce

(57) ABSTRACT

A pressure adjuster for changing pressure between a plurality of opposed bodies pressed against each other includes a cam rotatable in a given direction of rotation and having a top dead center on an outer circumferential surface thereof that is distanced farthest from a rotation axis of the cam. A driver is connected to the cam to drive and rotate the cam. A cam rest contacts the cam and is connected to one of the plurality of opposed bodies. A cam regulation assembly is connected to the cam to regulate rotation of the cam at least when the top dead center of the cam passes a contact position where the cam contacts the cam rest.

20 Claims, 9 Drawing Sheets

(56) References Cited

U.S. PATENT DOCUMENTS

| | | | |
|---|---|---|---|
| 2009/0067902 | A1 | 3/2009 | Yoshinaga et al. |
| 2009/0123202 | A1 | 5/2009 | Yoshinaga et al. |
| 2009/0148204 | A1 | 6/2009 | Yoshinaga et al. |
| 2012/0045226 | A1 | 2/2012 | Hase et al. |
| 2012/0051766 | A1 | 3/2012 | Ueno et al. |
| 2012/0093531 | A1 | 4/2012 | Yuasa et al. |
| 2012/0121304 | A1 | 5/2012 | Tokuda et al. |

OTHER PUBLICATIONS

U.S. Appl. No. 14/013,206, filed Aug. 29, 2013.
U.S. Appl. No. 14/014,653, filed Aug. 30, 2013.
U.S. Appl. No. 14/015,035, filed Aug. 30, 2013.
U.S. Appl. No. 14/024,931, filed Sep. 12, 2013.
U.S. Appl. No. 14/072,027, filed Nov. 5, 2013.
U.S. Appl. No. 13/929,920, filed Jun. 28, 2013.
U.S. Appl. No. 13/930,582, filed Jun. 28, 2013.

* cited by examiner

PRESSURE ADJUSTER, FIXING DEVICE, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-053789, filed on Mar. 15, 2013, and 2013-107933, filed on May 22, 2013, in the Japanese Patent Office, the entire disclosure of each of which is hereby incorporated by reference herein.

BACKGROUND

1. Technical Field

Example embodiments generally relate to a pressure adjuster, a fixing device, and an image forming apparatus, and more particularly, to a pressure adjuster for changing pressure between a plurality of opposed bodies and a fixing device and an image forming apparatus incorporating the pressure adjuster.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such image forming apparatus may incorporate a pair of opposed bodies, such as a pair of rollers, pressed against each other. For example, the fixing device incorporated in the image forming apparatus may include a fixing rotary body and a pressing rotary body pressed against the fixing rotary body. A spring biases the pressing rotary body against the fixing rotary body to form a fixing nip therebetween. As the recording medium bearing the toner image is conveyed through the fixing nip, the fixing rotary body and the pressing rotary body apply heat and pressure to the recording medium, thus melting and fixing the toner image on the recording medium.

The fixing device may further include a mechanism to decrease pressure between the fixing rotary body and the pressing rotary body to facilitate removal of the recording medium accidentally jammed between the fixing rotary body and the pressing rotary body or to prevent creeping of the fixing rotary body and the pressing rotary body which may arise after the pressing rotary body is pressed against the fixing rotary body for an extended period of time. For example, JP-2009-139682-A discloses a cam that rotates to decrease pressure exerted by a pressure roller biased by a spring. However, the cam may produce noise as it rotates.

SUMMARY

At least one embodiment provides a novel pressure adjuster for changing pressure between a plurality of opposed bodies pressed against each other. The pressure adjuster includes a cam rotatable in a given direction of rotation and having a top dead center on an outer circumferential surface thereof that is distanced farthest from a rotation axis of the cam. A driver is connected to the cam to drive and rotate the cam. A cam rest contacts the cam and is connected to one of the plurality of opposed bodies. A cam regulation assembly is connected to the cam to regulate rotation of the cam at least when the top dead center of the cam passes a contact position where the cam contacts the cam rest.

At least one embodiment provides a novel fixing device that includes a fixing rotary body rotatable in a given direction of rotation, a heater disposed opposite and heating the fixing rotary body, a pressing rotary body pressed against the fixing rotary body to form a fixing nip therebetween, a pressurization assembly to press the pressing rotary body against the fixing rotary body; and a pressure adjuster contacting the pressurization assembly to change pressure between the pressing rotary body and the fixing rotary body. The pressure adjuster includes a cam rotatable in a given direction of rotation and having a top dead center on an outer circumferential surface thereof that is distanced farthest from a rotation axis of the cam. A driver is connected to the cam to drive and rotate the cam. A cam rest contacts the cam and is connected to the pressurization assembly. A cam regulation assembly is connected to the cam to regulate rotation of the cam at least when the top dead center of the cam passes a contact position where the cam contacts the cam rest.

At least one embodiment provides a novel image forming apparatus that includes the pressure adjuster described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
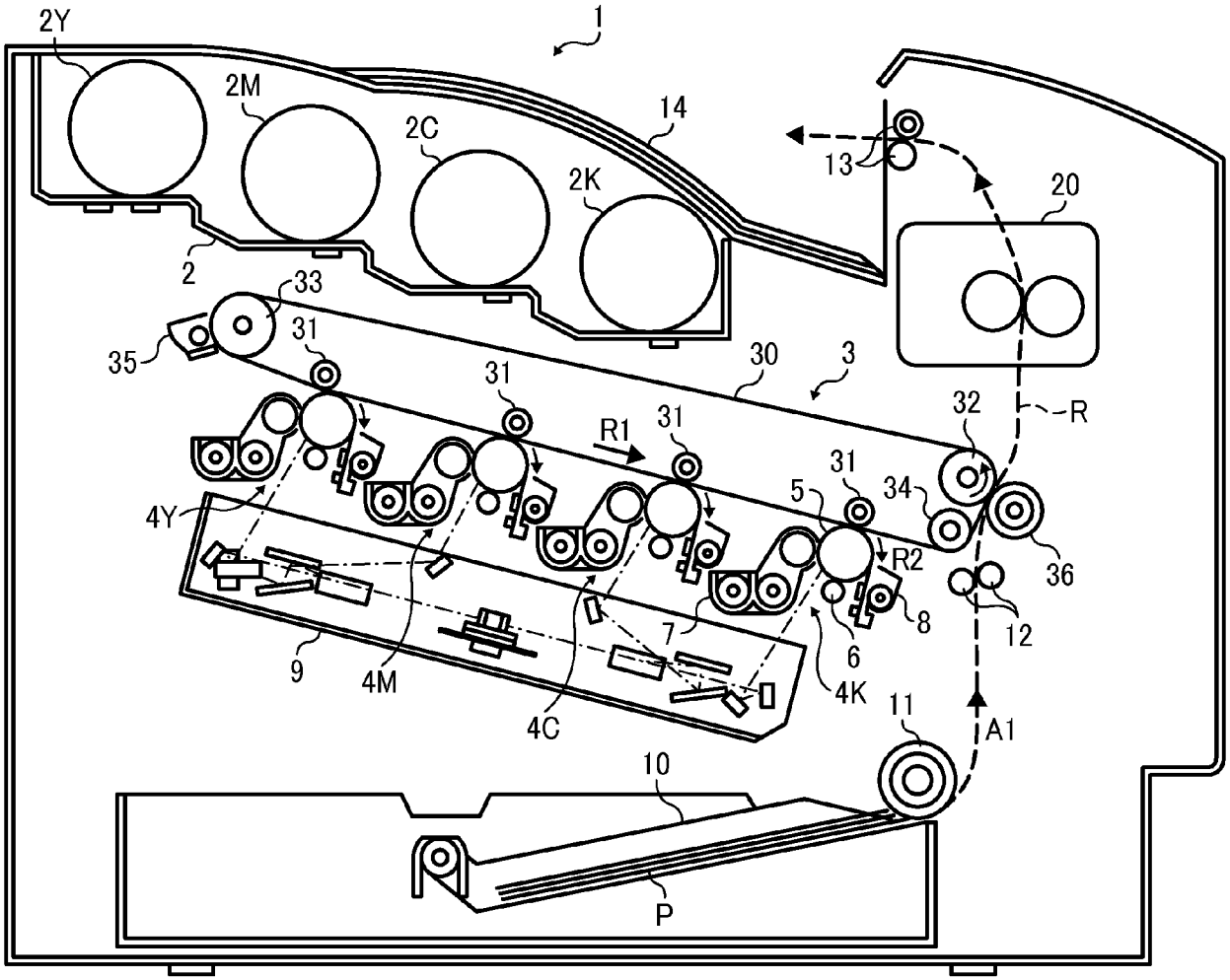
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath". "below". "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a color laser printer that forms color and monochrome toner images on recording media by electrophotography.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a given direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a given direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a given polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
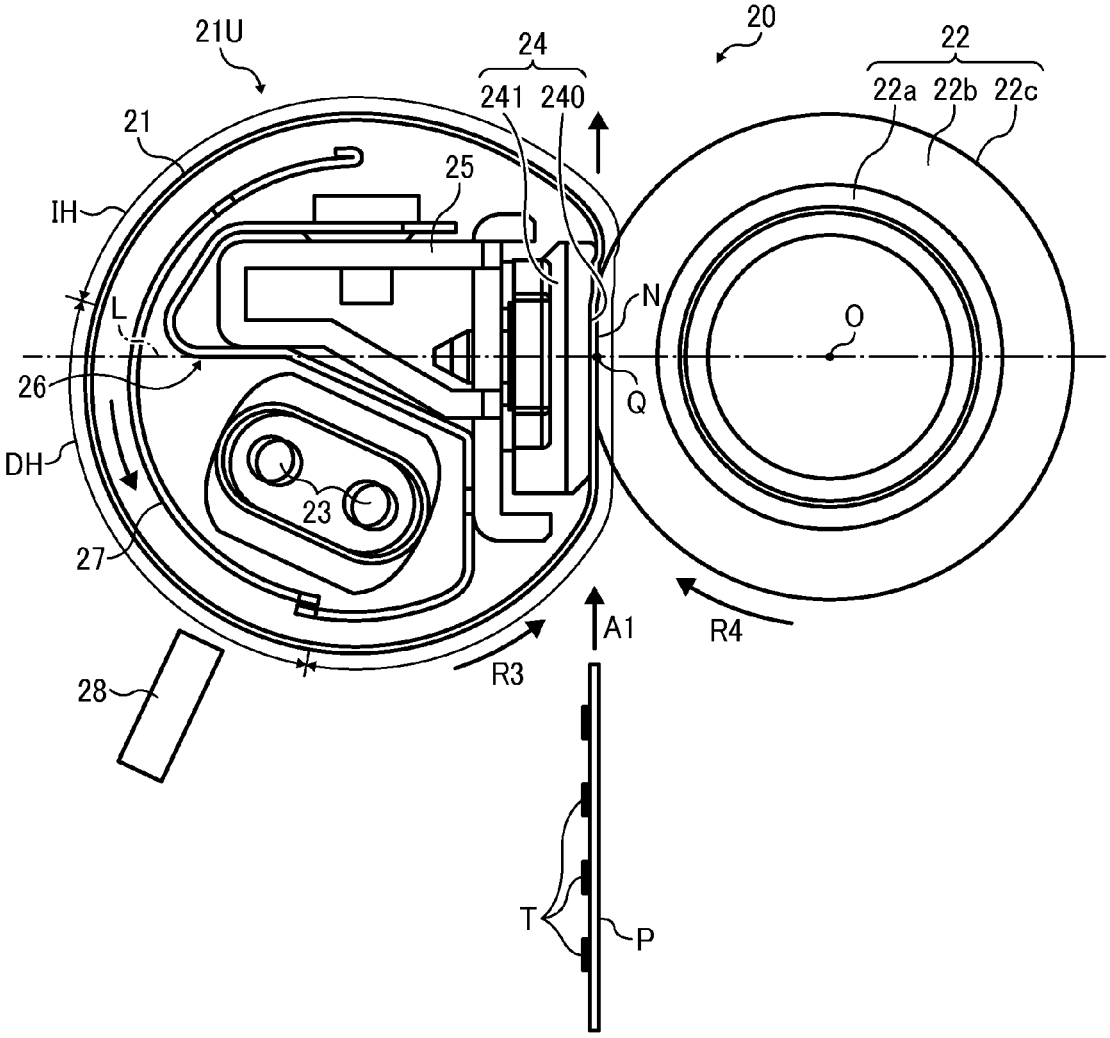
FIG. 2 is a vertical sectional view of a fixing device incorporated in the image forming apparatus shown in FIG. 1 illustrating a heat shield incorporated therein that is situated at a shield position.
Figure 3:
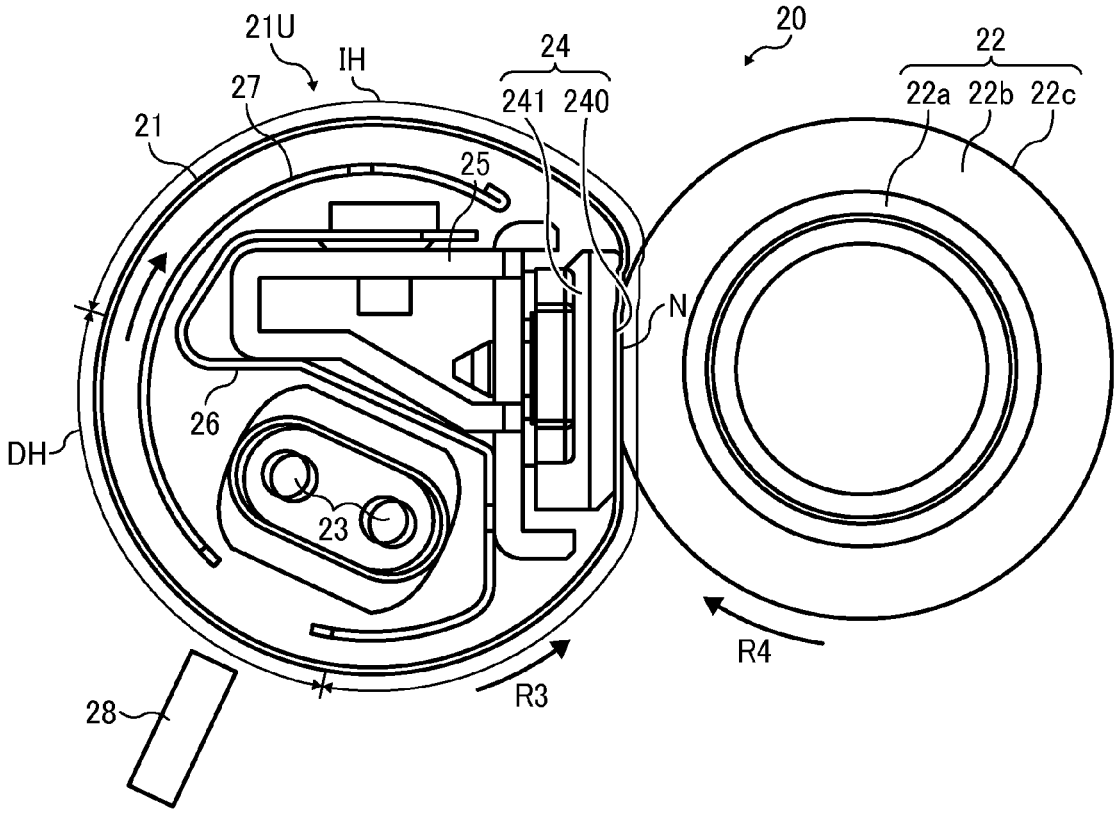
FIG. 3 is a vertical sectional view of the fixing device shown in FIG. 2 illustrating the heat shield situated at a retracted position.

With reference to FIGS. 2 and 3, a description is provided of a construction of the fixing device 20 incorporated in the image forming apparatus 1 described above.

FIG. 2 is a vertical sectional view of the fixing device 20 illustrating a heat shield 27 incorporated therein that is situated at a shield position. FIG. 3 is a vertical sectional view of the fixing device 20 illustrating the heat shield 27 situated at a retracted position.

As shown in FIG. 2, the fixing device 20 (e.g., a fuser) includes a fixing belt 21 serving as a fixing rotary body or an endless belt formed into a loop and rotatable in a rotation direction R3; a pressure roller 22 serving as a pressing rotary body, rotatable in a rotation direction R4 counter to the rotation direction R3 of the fixing belt 21, disposed opposite an outer circumferential surface of the fixing belt 21 and separably pressed against the fixing belt 21; a halogen heater pair 23 serving as a heater disposed inside the loop formed by the fixing belt 21 and heating the fixing belt 21; a nip formation assembly 24 disposed inside the loop formed by the fixing belt 21 and pressing against the pressure roller 22 via the fixing belt 21 to form a fixing nip N between the fixing belt 21 and the pressure roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater pair 23 toward the fixing belt 21; the heat shield 27 interposed between the halogen heater pair 23 and the fixing belt 21 to shield the fixing belt 21 from light radiated from the halogen heater pair 23; and a temperature sensor 28 serving as a temperature detector disposed opposite the outer circumferential surface of the fixing belt 21 and detecting the temperature of the fixing belt 21.

The fixing belt 21 and the components disposed inside the loop formed by the fixing belt 21, that is, the halogen heater pair 23, the nip formation assembly 24, the stay 25, the reflector 26, and the heat shield 27, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated to a desired fixing temperature quickly. However, as the pressure roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 100 micrometers. The elastic layer having the thickness not smaller than about 100 micrometers elastically deforms to absorb slight surface asperities of the fixing belt 21, preventing variation in gloss of the toner image T on the recording medium P.

According to this example embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly presses the pressure roller 22 against the nip formation assembly 24 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a desired length in the recording medium conveyance direction A1.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

According to this example embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater pair 23.

As shown in FIG. 2, the halogen heater pair 23 is situated inside the loop formed by the fixing belt 21 and upstream from the fixing nip N in the recording medium conveyance direction A1. For example, the halogen heater pair 23 is situated lower than and upstream from a hypothetical line L passing through a center Q of the fixing nip N in the recording medium conveyance direction A1 and an axis O of the pressure roller 22 in FIG. 2. The power supply situated inside the image forming apparatus 1 supplies power to the halogen heater pair 23 so that the halogen heater pair 23 heats the fixing belt 21. A controller (e.g., a processor), that is, a central processing unit (CPU) provided with a random-access memory (RAM) and a read-only memory (ROM), for example, operatively connected to the halogen heater pair 23 and the temperature sensor 28 controls the halogen heater pair 23 based on the temperature of the outer circumferential surface of the fixing belt 21 detected by the temperature sensor 28 so as to adjust the temperature of the fixing belt 21 to a desired fixing temperature. Alternatively, the controller may be operatively connected to a temperature sensor disposed opposite the pressure roller 22 to detect the temperature of the pressure roller 22 so that the controller predicts the temperature of the fixing belt 21 based on the temperature of the pressure roller 22 detected by the temperature sensor, thus controlling the halogen heater pair 23.

According to this example embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to the sizes of the recording media P available in the image forming apparatus 1. Alternatively, instead of the halogen heater pair 23, an induction heater, a resistance heat generator, a carbon heater, or the like may be employed as a heater that heats the fixing belt 21.

A detailed description is now given of a construction of the nip formation assembly 24.

The nip formation assembly 24 includes a base pad 241 and a slide sheet 240 (e.g., a low-friction sheet) covering an outer surface of the base pad 241. For example, the slide sheet 240 covers an opposed face of the base pad 241 disposed opposite the fixing belt 21. A longitudinal direction of the base pad 241 is parallel to an axial direction of the fixing belt 21 or the pressure roller 22. The base pad 241 receives pressure from the pressure roller 22 to define the shape of the fixing nip N. According to this example embodiment, the fixing nip N is planar in cross-section as shown in FIG. 2. Alternatively, the fixing nip N may be concave with respect to the pressure roller 22 or have other shapes. The slide sheet 240 reduces friction between the base pad 241 and the fixing belt 21 sliding thereover as the fixing belt 21 rotates in the rotation direction R3. Alternatively, the base pad 241 may be made of a low friction material. In this case, the slide sheet 240 is not interposed between the base pad 241 and the fixing belt 21.

The base pad 241 is made of a heat resistant material resistant against temperatures of 200 degrees centigrade or higher to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 241 is made of general heat resistant resin such as polyether sulfone (PES), polyphenylene sulfide (PPS), liquid crystal polymer (LCP), polyether nitrile (PEN), polyimide imide (PAI), polyether ether ketone (PEEK), or the like.

The base pad 241 is mounted on and supported by the stay 25. Accordingly, even if the base pad 241 receives pressure from the pressure roller 22, the base pad 241 is not bent by the pressure and therefore produces a uniform nip width throughout the entire width of the pressure roller 22 in the axial direction thereof. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as LCP, metal, ceramic, or the like.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25. Thus, the reflector 26 facilitates efficient heating of the fixing belt 21, saving energy. For example, the reflector 26 is made of aluminum, stainless steel, or the like. If the reflector 26 includes an aluminum base treated with silver-vapor-deposition to decrease radiation and increase reflectance of light, the reflector 26 heats the fixing belt 21 effectively.

A detailed description is now given of a configuration of the heat shield 27.

The heat shield 27 is a metal plate, having a thickness in a range of from about 0.1 mm to about 1.0 mm, curved in a circumferential direction of the fixing belt 21 along the inner circumferential surface thereof. The heat shield 27 is movable in the circumferential direction of the fixing belt 21. As shown in FIG. 2, a circumference of the fixing belt 21 is divided into two sections: a circumferential, direct heating span DH where the halogen heater pair 23 is disposed opposite and heats the fixing belt 21 directly and a circumferential, indirect heating span IH where the halogen heater pair 23 is disposed opposite the fixing belt 21 indirectly via the components other than the heat shield 27, that is, the reflector 26, the stay 25, the nip formation assembly 24, and the like. The heat shield 27 moves to the shield position shown in FIG. 2 where the heat shield 27 is disposed opposite the halogen heater pair 23 directly in the direct heating span DH to shield the fixing belt 21 from the halogen heater pair 23.

Conversely, the heat shield 27 moves to the retracted position shown in FIG. 3 where the heat shield 27 retracts from the direct heating span DH to the indirect heating span IH and therefore is disposed opposite the halogen heater pair 23 indirectly. That is, the heat shield 27 is behind the reflector 26 and the stay 25 and therefore disposed opposite the halogen heater pair 23 via the reflector 26 and the stay 25. Thus, the heat shield 27 does not shield the fixing belt 21 from the halogen heater pair 23. The heat shield 27 is made of a heat resistant material, for example, metal such as aluminum, iron, and stainless steel or ceramic.

Figure 4:
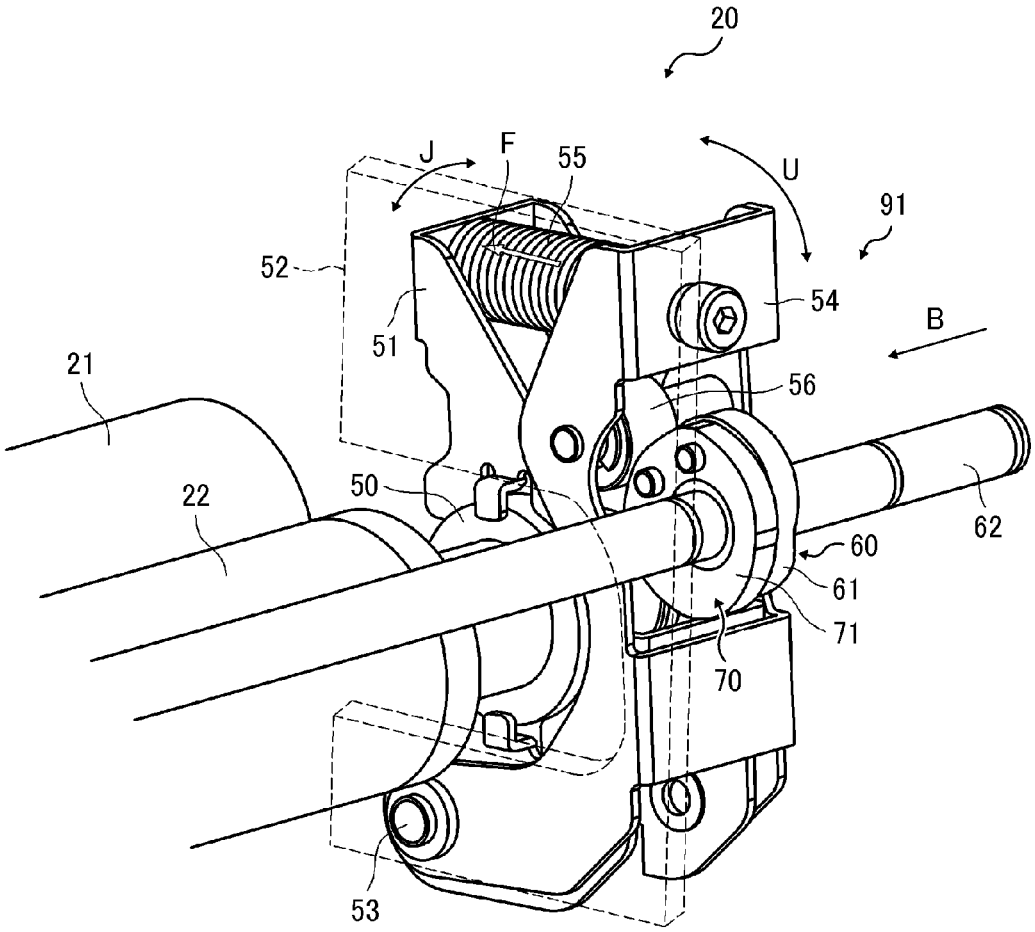
FIG. 4 is a partial perspective view of the fixing device shown in FIG. 2 illustrating a support assembly and a pressure adjuster incorporated therein.

With reference to FIG. 4, a description is provided of a construction of a support assembly 91 that supports the pressure roller 22.

FIG. 4 is a partial perspective view of the fixing device 20 illustrating the support assembly 91 incorporated therein. Although FIG. 4 illustrates the support assembly 91 mounting one lateral end of the pressure roller 22 in the axial direction thereof, the support assembly 91 also mounts another lateral end of the pressure roller 22 in the axial direction thereof. However, since both support assemblies 91 have an identical structure, the following describes a construction of the support assembly 91 mounting one lateral end of the pressure roller 22 in the axial direction thereof.

As shown in FIG. 4, the support assembly 91 serving as a pressurization assembly includes a bearing 50, a holder 51, and a shaft 53. For example, one lateral end of the pressure roller 22 in the axial direction thereof is supported by the holder 51 through the bearing 50 (e.g., a ball bearing or a plain bearing). A lower portion of the holder 51 in FIG. 4 is supported by the shaft 53 swaged into and mounted on a side plate 52 of the fixing device 20. The holder 51 is pivotable about the shaft 53 in a direction J.

The support assembly 91 further includes a lever 54 attached to the holder 51 such that the lever 54 is disposed opposite the fixing belt 21 via the holder 51. Similar to the holder 51, a lower portion of the lever 54 in FIG. 4 is supported by the shaft 53 about which the lever 54 is pivotable in a direction U. The support assembly 91 further includes a spring 55 serving as a biasing member. The spring 55 is supported by and compressed between an upper portion of the holder 51 and an upper portion of the lever 54 in FIG. 4. As the holder 51 receives resilience from the spring 55, the holder 51 receives pressure exerted in a direction F, thus pressing the pressure roller 22 supported by the holder 51 against the fixing belt 21.

A description is provided of a construction of a pressure adjuster 60 that changes pressure between the fixing belt 21 and the pressure roller 22 pressed against the fixing belt 21 by the support assembly 91.

As shown in FIG. 4, the fixing device 20 further includes the pressure adjuster 60 situated at a lateral end of the pressure roller 22 in the axial direction thereof to change pressure between the fixing belt 21 and the pressure roller 22. The pressure adjuster 60 includes a shaft 62 and an eccentric cam 61 mounted on the shaft 62 through a detent such as a parallel pin and a spring pin. The pressure adjuster 60 further includes a roller 56 serving as a cam rest attached to the lever 54 of the support assembly 91 and contacted by the cam 61.

Figure 5:
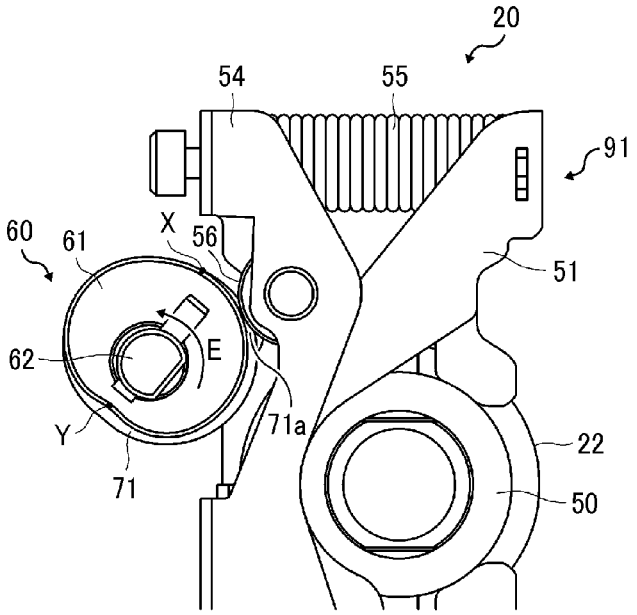
FIG. 5 is a side view of the support assembly and the pressure adjuster seen in a direction B in FIG. 4.

FIG. 5 is a side view of the support assembly 91 and the pressure adjuster 60 seen in a direction B in FIG. 4. As shown in FIG. 5, the cam 61 has a top dead center X situated on an outer circumferential surface of the cam 61 and distanced farthest from a rotation axis, that is, the shaft 62, of the cam 61 and a bottom dead center Y situated on the outer circumferential surface of the cam 61 and distanced closest to the rotation axis of the cam 61. As the cam 61 rotates in a rotation direction E, the cam 61 comes into contact with the roller 56 at the top dead center X and the bottom dead center Y of the cam 61. As the cam 61 contacts the roller 56 at the top dead center X, the cam 61 presses the lever 54 against the spring 55, compressing the spring 55 further and allowing the holder 51 to press the pressure roller 22 against the fixing belt 21 with increased pressure therebetween. Conversely, as the cam 61 contacts the roller 56 at the bottom dead center Y, the cam 61 presses the lever 54 against the spring 55 with decreased pressure therebetween, allowing the holder 51 to press the pressure roller 22 against the fixing belt 21 with decreased pressure therebetween. Since the roller 56 rotatable in accordance with rotation of the cam 61 is used as a cam rest, the pressure adjuster 60 changes pressure between the pressure roller 22 and the fixing belt 21 smoothly.

The pressure adjuster 60 changes pressure between the pressure roller 22 and the fixing belt 21 for various purposes. For example, if a recording medium P is jammed at the fixing nip N formed between the pressure roller 22 and the fixing belt 21, the pressure adjuster 60 decreases pressure between the pressure roller 22 and the fixing belt 21, facilitating removal of the recording medium P from the fixing nip N. If the image forming apparatus 1 depicted in FIG. 1 is not used for a substantial time, the pressure adjuster 60 decreases pressure between the pressure roller 22 and the fixing belt 21, preventing the pressure roller 22 and the fixing belt 21 from creeping at the fixing nip N. If thick paper such as an envelope used as a recording medium P is conveyed through the fixing nip N, the pressure adjuster 60 decreases pressure between the pressure roller 22 and the fixing belt 21, preventing the thick paper from creasing.

The cam 61 situated at one lateral end of the pressure roller 22 in the axial direction thereof and the cam 61 situated at another lateral end of the pressure roller 22 in the axial direction thereof are mounted on the identical shaft 62. Both cams 61 have the top dead center X and the bottom dead center Y distanced in a circumferential direction of the cams 61 with an identical phase therebetween. Accordingly, the pressure adjuster 60 situated at one lateral end of the pressure roller 22 in the axial direction thereof increases and decreases pressure between the pressure roller 22 and the fixing belt 21 in synchronism with the pressure adjuster 60 situated at another lateral end of the pressure roller 22 in the axial direction thereof.

When the fixing belt 21 is used as a fixing rotary body as in this example embodiment, if pressure exerted by the pressure roller 22 to the fixing belt 21 varies between one lateral end and another lateral end of the pressure roller 22 in the axial direction thereof, the fixing belt 21 may be skewed in the axial direction thereof. To address this circumstance, the cam 61 situated at one lateral end of the pressure roller 22 in the axial direction thereof may be driven and rotated independently from the cam 61 situated at another lateral end of the pressure roller 22 in the axial direction thereof, thus preventing variation in pressure exerted by the pressure roller 22 to the fixing belt 21.

Incidentally, if the cam 61 is configured to contact the roller 56 constantly while the cam 61 is rotated to change pressure between the pressure roller 22 and the fixing belt 21, as a contact position where the cam 61 contacts the roller 56 switches from the bottom dead center Y to the top dead center X, resilience received by the cam 61 from the pressure roller 22 increases gradually, throwing an increasing load on the cam 61. As the cam 61 comes into contact with the roller 56 at the top dead center X, that is, as the cam 61 presses the lever 54 against the holder 51 farthest, resilience received by the cam 61 from the pressure roller 22 is greatest, throwing the greatest load on the cam 61.

However, as the top dead center X of the cam 61 passes the contact position where the cam 61 contacts the roller 56, load placed on the cam 61 may decrease sharply, increasing the rotation speed of the cam 61 transiently. If the transient increase of the rotation speed of the cam 61 separates the cam 61 from an outer circumferential surface of the roller 56 momentarily, noise (e.g., collision sound) may be produced as the cam 61 comes into contact with the roller 56 again.

To address this circumstance, the pressure adjuster 60 further includes a cam regulation assembly 70 that regulates rotation of the cam 61 as shown in FIG. 4.

As shown in FIG. 4, the cam regulation assembly 70 includes a cam regulator 71 rotatable in accordance with rotation of the cam 61. The cam regulator 71 is mounted on the shaft 62 such that the cam regulator 71 adjoins the cam 61 and contacts the roller 56.

The cam regulator 71 is made of an elastic body. For example, since the cam regulator 71 is installed in the fixing device 20 accommodating the halogen heater pair 23, the cam regulator 71 is made of a heat resistant, elastic body such as silicone rubber and fluoro rubber in solid or sponge form.

As shown in FIG. 5, the cam regulator 71 is mounted on the shaft 62 eccentrically. The cam regulator 71 partially projects beyond the outer circumferential surface of the cam 61 radially. For example, the cam regulator 71 projects beyond the cam 61 radially in a circumferential span spanning from the top dead center X to a point beyond the bottom dead center Y in a direction counter to the rotation direction E of the cam 61.

Figure 6:
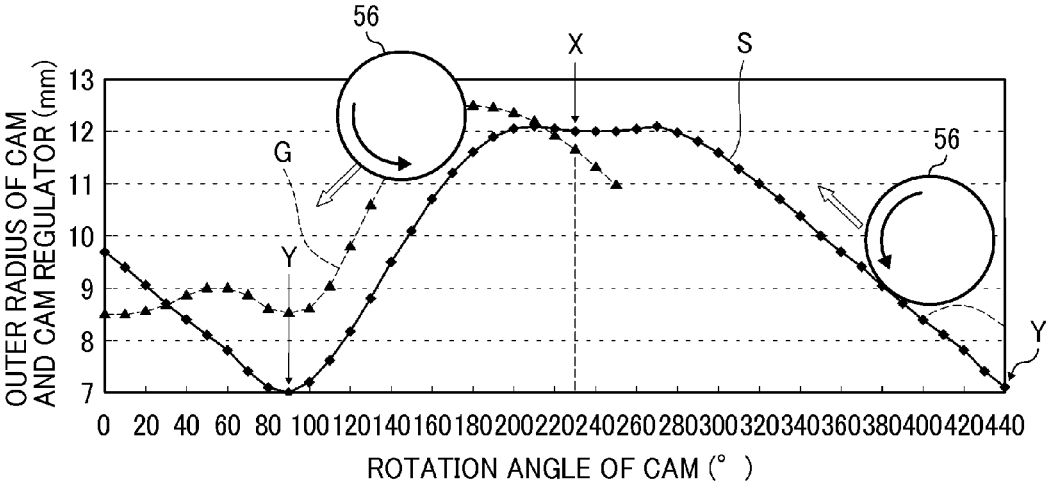
FIG. 6 is a graph showing a relation between a rotation angle of a cam incorporated in the pressure adjuster shown in FIG. 4 and an outer radius of the cam and a cam regulator incorporated in the pressure adjuster shown in FIG. 4.

With reference to FIG. 6, a description is provided of regulation of rotation of the cam 61 performed by the cam regulation assembly 70.

FIG. 6 is a graph showing a relation between a rotation angle of the cam 61 and an outer radius of the cam 61 and the cam regulator 71. In FIG. 6, the horizontal axis of the graph represents the rotation angle of the cam 61. The vertical axis of the graph represents the outer radius of the cam 61 and the cam regulator 71, that is, the length from the rotation axis to the contact position where the outer circumferential surface of the cam 61 and the cam regulator 71 contacts the roller 56. The solid curve S represents the outer radius of the cam 61. The dotted curve G represents the outer radius of the cam regulator 71. It is to be noted that FIG. 6 virtually illustrates the roller 56 rotating and moving on the outer circumferential surface of the cam 61 indicated by the solid curve S in accordance with rotation of the cam 61.

As shown in FIG. 6, as the roller 56 moves leftward from the lower right, bottom dead center Y to the upper, top dead center X of the cam 61, the outer radius of the cam 61 increases gradually. Accordingly, a force to move the roller 56 up on the outer circumferential surface of the cam 61 is needed. That is, a force to suppress rotation of the cam 61 increases. Conversely, as the roller 56 passes the top dead center X of the cam 61, the roller 56 moves down on the outer circumferential surface of the cam 61 by a force greater than the force to move the roller 56 up on the outer circumferential surface of the cam 61. That is, the force to suppress rotation of the cam 61 decreases. In this case, if the roller 56 moves down on the outer circumferential surface of the cam 61 quickly, the roller 56 may not slide over the outer circumferential surface of the cam 61 and therefore may separate from the cam 61 momentarily.

To address this circumstance, according to this example embodiment, as the roller 56 passes the top dead center X of the cam 61, that is, as the roller 56 moves down on the outer circumferential surface of the cam 61 quickly, since an outer circumferential surface of the cam regulator 71 made of an elastic body projects beyond the cam 61 radially, the roller 56 pressingly contacts the cam regulator 71. For example, an increased radius portion 71*a* of the cam regulator 71 that projects beyond the cam 61 radially contacts the roller 56 as shown in FIG. 5. Accordingly, the cam regulator 71 produces resistance to movement of the roller 56, suppressing quick increase in the rotation speed of the roller 56. That is, the cam regulator 71 suppresses quick increase in the rotation speed of the cam 61. As described above, the cam regulator 71 according to this example embodiment suppresses quick increase in the rotation speed of the roller 56 immediately after the roller 56 passes the top dead center X of the cam 61, thus preventing the roller 56 from separating from the cam 61. Even if the roller 56 separates from the cam 61, since the cam regulator 71 made of an elastic body contacts the roller 56, the cam regulator 71 absorbs impact caused by the roller 56 coming into contact with the cam 61 again, preventing noise.

As described above, the cam regulator 71 suppresses quick increase in the rotation speed of the cam 61, preventing the cam 61 from separating from the roller 56. Additionally, even if the cam 61 separates from the roller 56, the cam regulator 71 absorbs impact caused by the cam 61 striking the roller 56 as the cam 61 comes into contact with the roller 56 again, preventing noise that may be produced as the cam 61 comes into contact with the roller 56 again.

As shown in FIG. 5, the cam regulator 71 projects beyond the cam 61 radially in a substantial span in the circumferential direction of the cam 61. However, if the cam regulator 71 projects beyond the cam 61 radially at least in a circumferential span spanning from the top dead center X to a vicinity of the top dead center X in the direction counter to the rotation direction E of the cam 61, the cam regulator 71 suppresses increase in the rotation speed of the roller 56 immediately after the top dead center X of the cam 61 passes the contact position where the cam 61 contacts the roller 56. Conversely, in the vicinity of the top dead center X of the cam 61 in the rotation direction E of the cam 61, an increased load is imposed on the cam 61. Hence, the cam regulator 71 does not project beyond the cam 61 radially in the vicinity of the top dead center X of the cam 61, facilitating rotation of the cam 61.

Figure 7:
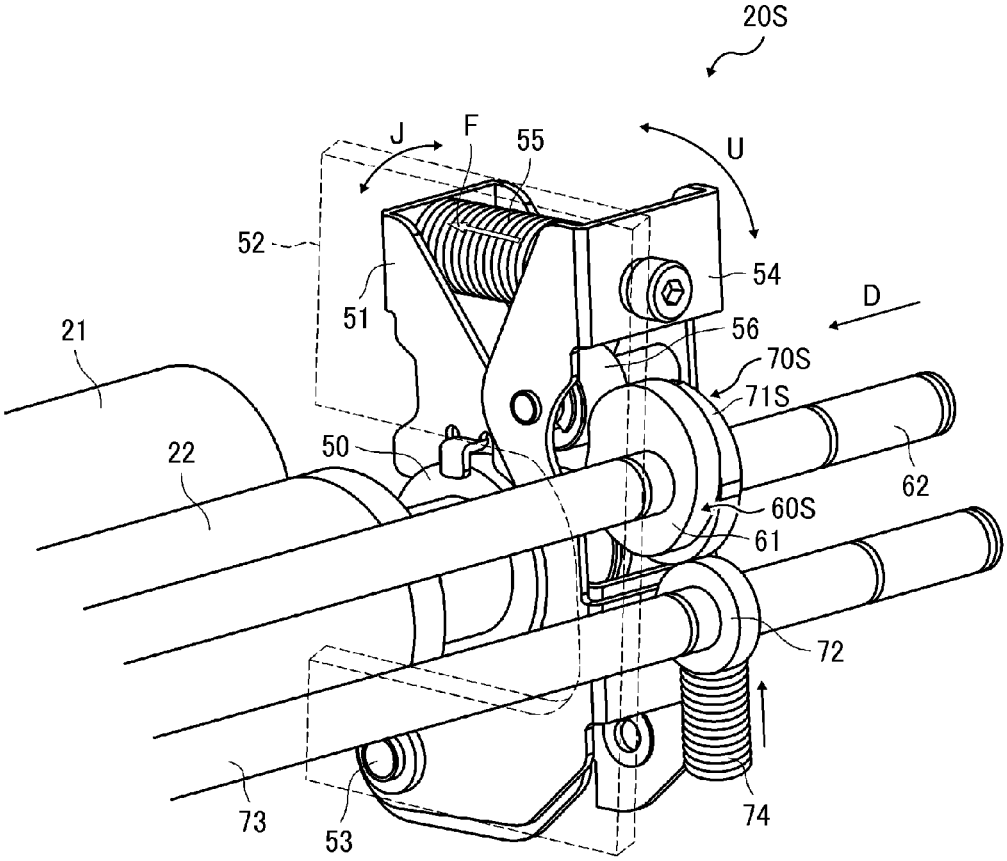
FIG. 7 is a partial perspective view of a fixing device according to another example embodiment.

With reference to FIG. 7, a description is provided of a construction of a fixing device 20S incorporating a pressure adjuster 60S according to another example embodiment.

FIG. 7 is a partial perspective view of the fixing device 20S. As shown in FIG. 7, the fixing device 20S includes the pressure adjuster 60S that incorporates a cam regulation assembly 70S. The cam regulator 71 of the cam regulation assembly 70 depicted in FIG. 4 contacts the roller 56. Conversely, the cam regulation assembly 70S includes a cam regulator 71S in contact with a rotor 72 serving as an abutment. Although the cam regulator 71 depicted in FIG. 4 is made of an elastic body, the cam regulator 71S is made of a material not elastically deformable, similarly to the cam 61. Conversely, the rotor 72 is made of an elastic body. For example, the rotor 72 is made of a heat resistant material such as silicone rubber and fluoro rubber in solid or sponge form. Alternatively, the rotor 72 may be made of heat resistant, low-friction resin such as PPS, PAI, and polyamide (PA).

The cam regulation assembly 70S further includes a shaft 73 that rotatably supports the rotor 72. The shaft 73 is attached to the side plate 52 of the fixing device 20S such that the shaft 73 is movable vertically in FIG. 7. Hence, the rotor 72 is supported by the shaft 73 such that the rotor 72 comes into contact with and separates from the cam regulator 71S. A spring 74 serving as a biasing member biases the rotor 72 against the cam regulator 71S. Thus, the spring 74 brings the rotor 72 into constant contact with the cam regulator 71S.

Figure 8:
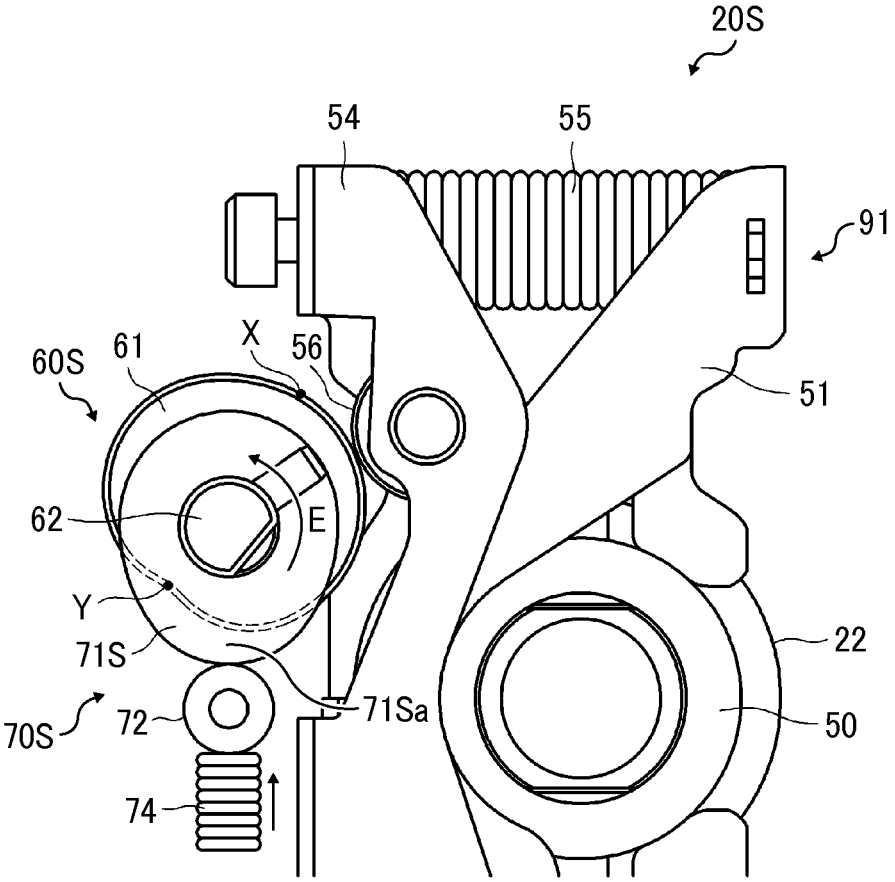
FIG. 8 is a side view of the support assembly and a cam regulation assembly incorporated in the fixing device shown in FIG. 7 seen in a direction D in FIG. 7.

The cam regulator 71S is eccentrically mounted with respect to the shaft 62. FIG. 8 is a side view of the support assembly 91 and the cam regulation assembly 70S seen in a direction D in FIG. 7. As shown in FIG. 8, when the top dead center X of the cam 61 passes the contact position where the cam 61 contacts the roller 56, an increased radius portion 71Sa of the cam regulator 71S contacts the rotor 72.

That is, as the top dead center X of the cam 61 passes the contact position where the cam 61 contacts the roller 56, the rotor 72 is pressed against the cam regulator 71S with increased pressure while the rotor 72 is elastically deformed, thus increasing load imposed on the cam 61. The increased load regulates rotation of the cam 61, suppressing increase in the rotation speed of the cam 61 immediately after the top dead center X of the cam 61 passes the contact position where the cam 61 contacts the roller 56. The cam regulator 71S in contact with the rotor 72 suppresses increase in the rotation speed of the cam 61, preventing the cam 61 from separating from the roller 56 and therefore preventing noise that may be produced as the cam 61 comes into contact with the roller 56 again.

Immediately before the top dead center X of the cam 61 passes the contact position where the cam 61 contacts the roller 56, an increased load is imposed on the cam 61. To address this circumstance, a decreased radius portion other than the increased radius portion 71Sa of the cam regulator 71S contacts the rotor 72, facilitating rotation of the cam 61.

Alternatively, the cam regulator 71S may be made of an elastic body and the rotor 72 may be made of a nonelastic body. In this case also, the rotor 72 is pressed against the cam regulator 71S with increased pressure therebetween, regulating rotation of the cam 61.

The above describes the construction of the cam regulation assembly 70S installable in the fixing device 20S. Since the components of the fixing device 20S other than the cam regulation assembly 70S are equivalent to those shown in FIGS. 1 to 5, a description of those components is omitted.

Figure 9:
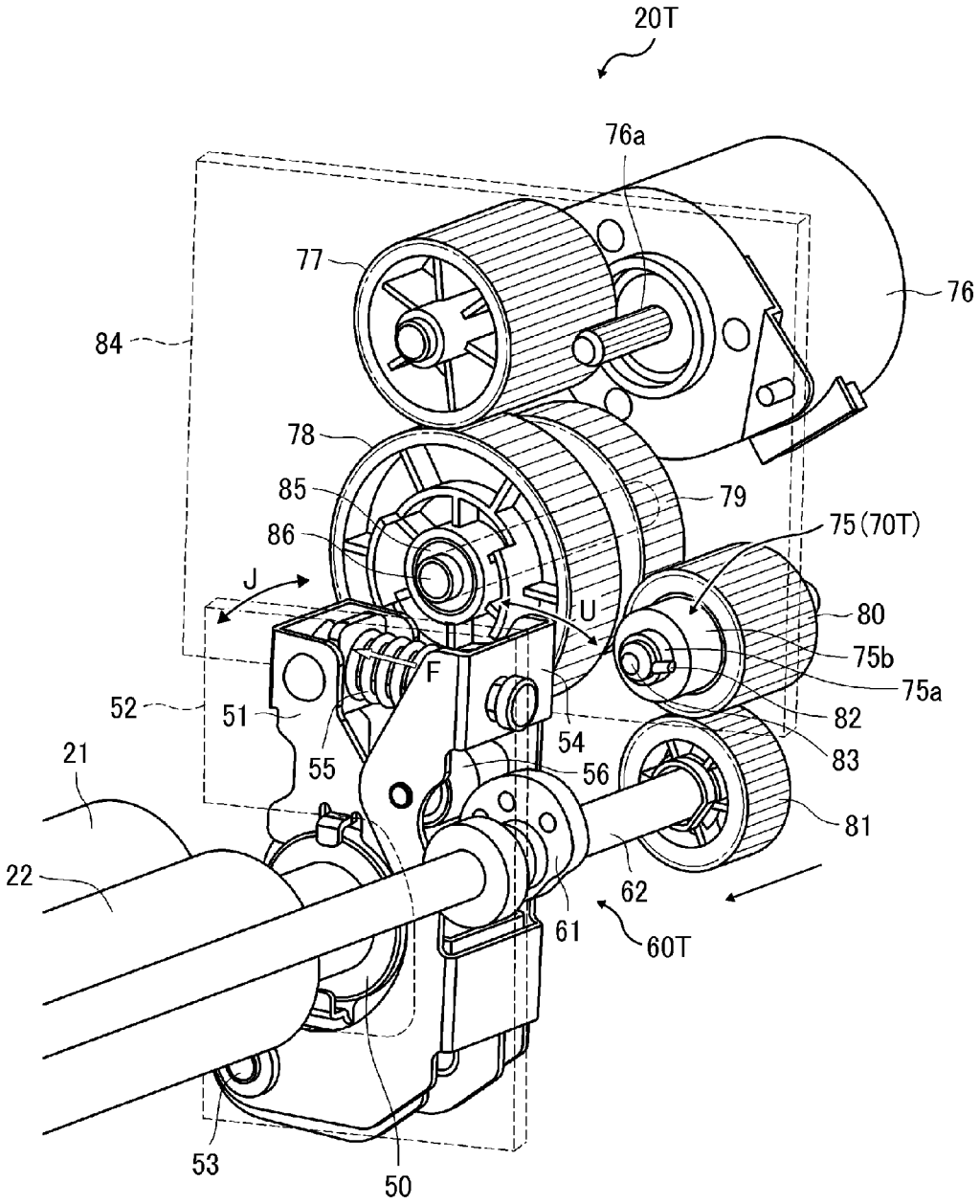
FIG. 9 is a partial perspective view of a fixing device according to yet another example embodiment.

With reference to FIG. 9, a description is provided of a construction of a fixing device 20T incorporating a pressure adjuster 60T according to yet another example embodiment.

FIG. 9 is a partial perspective view of the fixing device 20T. As shown in FIG. 9, the fixing device 20T includes the pressure adjuster 60T including a motor 76 that drives and rotates the cam 61. The motor 76 serves as a driver that produces a driving force to be transmitted to the cam 61. For example, the driving force produced by the motor 76 is transmitted to a first idler gear 77 engaging a driving shaft 76*a* of the motor 76. The driving force is further transmitted from the first idler gear 77 to a second idler gear 78 engaging the first idler gear 77. A shaft 86 mounting the second idler gear 78 also mounts a third idler gear 79. Hence, as the second idler gear 78 rotates, the third idler gear 79 also rotates. The driving force is transmitted to a fourth idler gear 80 engaging the third idler gear 79 and further transmitted to a driving gear 81 engaging the fourth idler gear 80 and mounted on the shaft 62 mounting the cam 61, thus driving and rotating the cam 61 together with the driving gear 81. The motor 76, the first idler gear 77, the second idler gear 78, the third idler gear 79, and the fourth idler gear 80 are supported by a support 84 (e.g., a support plate) located inside the image forming apparatus 1 depicted in FIG. 1.

The fourth idler gear 80 serving as a driving force transmitter mounts a torque limiter 75 of a cam regulation assembly 70T that regulates rotation of the cam 61. The torque limiter 75 includes an inner ring 75*a* and an outer ring 75*b*. The inner ring 75*a* is mounted on a mounting shaft 83 through a spring pin 82. The outer ring 75*b* is mounted on the fourth idler gear 80. A given load is constantly imposed between the inner ring 75*a* and the outer ring 75*b* by resilience or a magnetic force, applying a retaining force that retains the outer ring 75*b* to prevent the outer ring 75*b* from rotating with respect to the inner ring 75*a*. However, if the outer ring 75*b* is applied with a torque greater than the retaining force that retains the outer ring 75*b*, the outer ring 75*b* rotates with respect to the inner ring 75*a*. That is, if the outer ring 75*b* is applied with the torque greater than the retaining force that retains the outer ring 75*b*, the torque limiter 75 allows rotation of the fourth idler gear 80. Conversely, if the outer ring 75*b* is applied with a torque smaller than the retaining force that retains the outer ring 75*b*, the torque limiter 75 regulates rotation of the fourth idler gear 80.

The retaining force that retains the outer ring 75*b* defines a preset value of the torque limiter 75 that is smaller than the torque applied to the outer ring 75*b* from the motor 76. Accordingly, when the driving force produced by the motor 76 is transmitted to the fourth idler gear 80, the torque limiter 75 allows rotation of the fourth idler gear 80, thus rotating the cam 61.

Figure 10:
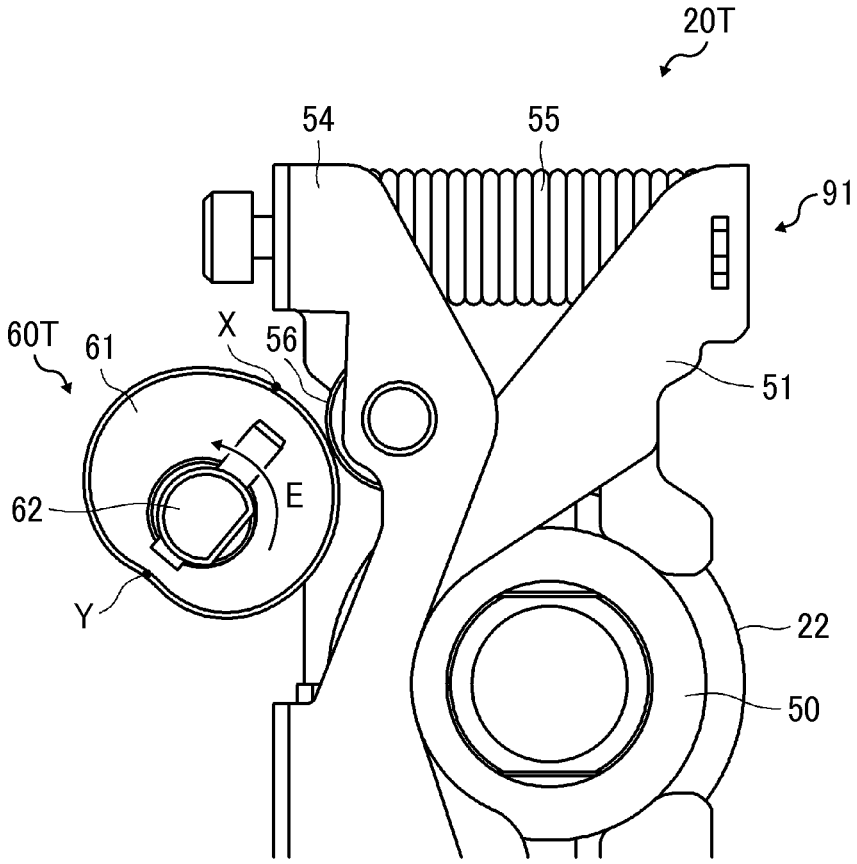
FIG. 10 is a side view of the support assembly and the pressure adjuster incorporated in the fixing device shown in FIG. 9.

Conversely, when the top dead center X of the cam 61 passes the contact position where the cam 61 contacts the roller 56 as shown in FIG. 10, the torque limiter 75 regulates a torque that facilitates rotation of the cam 61 in the rotation direction E, thus regulating rotation of the cam 61. FIG. 10 is a side view of the support assembly 91 and the pressure adjuster 60T incorporated in the fixing device 20T. For example, the preset value of the torque limiter 75 is set to be greater than the torque that facilitates rotation of the cam 61 in the rotation direction E. Accordingly, even if the torque that facilitates rotation of the cam 61 in the rotation direction E is produced, the torque limiter 75 prevents the rotation speed of the cam 61 from increasing. Consequently, the torque limiter 75 suppressing increase in the rotation speed of the cam 61 prevents the cam 61 from separating from the roller 56 and therefore prevents noise that may be produced as the cam 61 comes into contact with the roller 56 again.

Alternatively, instead of the torque limiter 75, an oil damper that produces resistance to rotation of the cam 61 by viscous drag of viscous fluid may be used as a cam regulation assembly that regulates rotation of the cam 61. The oil damper applies torque to the cam 61 stably for an extended period of time. However, since viscosity of oil of the oil damper is susceptible to thermal degradation, it is preferable to locate the oil damper at a position spaced apart from the fixing device 20T.

The motor 76 for driving the cam 61 may also be connected to one or more components of the fixing device 20T other than the cam 61. In this case, the single motor 76 drives the plurality of components of the fixing device 20T, reducing manufacturing costs of the fixing device 20T and downsizing the fixing device 20T. However, if the motor 76 is configured to drive the cam 61 and one or more components other than the cam 61 simultaneously, the motor 76 is upsized to output an increased driving force to overcome loads to drive the cam 61 and the torque limiter 75 in addition to one or more components other than the cam 61.

To address this circumstance, as shown in FIG. 9, the fixing device 20T further includes a one-way clutch 85 serving as a mechanism for releasing interlock between the torque limiter 75 and the cam 61 so as not to impose load to the torque limiter 75 and the cam 61 as the motor 76 drives one or more components other than the cam 61. For example, as shown in FIG. 9, the motor 76 is rotatable forward and backward. The one-way clutch 85 is attached to the second idler gear 78 interposed between the motor 76 and the torque limiter 75.

The one-way clutch 85 is a clutch mechanism for transmitting a driving force in one direction. When the one-way clutch 85 receives a forward driving force from the motor 76 that drives and rotates the cam 61, the one-way clutch 85 allows transmission of the forward driving force from the second idler gear 78 to the shaft 86. Conversely, when the one-way clutch 85 receives a backward driving force from the motor 76, the one-way clutch 85 causes the second idler gear 78 to rotate idly with respect to the shaft 86, prohibiting transmission of the backward driving force to the third idler gear 79.

Accordingly, when the motor 76 rotates backward, the backward driving force is not transmitted to the torque limiter 75 and the cam 61 and therefore is transmitted to one or more components other than the cam 61 to drive those components. That is, when the motor 76 drives one or more components other than the cam 61, load is not imposed on the torque limiter 75 and the cam 61. Hence, the motor 76 is downsized, resulting in reduced manufacturing costs and downsizing of the fixing device 20T.

The one-way clutch 85 that releases interlock between the torque limiter 75 and the cam 61 to drive one or more components other than the cam 61 is also applicable to the fixing devices 20 and 20S depicted in FIGS. 4 and 7, respectively.

The above describes the construction of the cam regulation assembly 70T installable in the fixing device 20T. Since the components of the fixing device 20T other than the cam regulation assembly 70T are equivalent to those shown in FIGS. 1 to 5, a description of those components is omitted.

As described above, at least when the top dead center X of the cam 61 passes the contact position where the cam 61 contacts the roller 56, the cam regulation assemblies 70, 70S, and 70T regulate rotation of the cam 61, suppressing increase in the rotation speed of the cam 61 immediately after the top dead center X of the cam 61 passes the contact position where the cam 61 contacts the roller 56. Accordingly, the cam regulation assemblies 70, 70S, and 70T prevent the cam 61 from separating from the roller 56, preventing noise (e.g., collision sound) that may be produced as the cam 61 comes into contact with the roller 56 again.

The present invention is not limited to the details of the example embodiments described above, and various modifications and improvements are possible. For example, as shown in FIGS. 4 and 7, a cam regulator (e.g., the cam regulators 71 and 71S) constantly contacts a counterpart (e.g., the roller 56 serving as a cam rest and the rotor 72 serving as an abutment). Alternatively, the cam regulator may not constantly contact the counterpart. That is, if one of the cam regulator and the counterpart contacts another one of the cam regulator and the counterpart while being elastically deformed when the top dead center X of the cam 61 passes the contact position where the cam 61 contacts the roller 56, the cam regulator regulates rotation of the cam 61 by frictional resistance between the cam regulator and the counterpart.

Further, the pressure adjusters 60, 60S, and 60T incorporating the cam regulators 71, 71S, and 71T, respectively, may be applicable to various devices other than the fixing devices 20, 20S, and 20T. For example, according to the example embodiments described above, the pressure adjusters 60, 60S, and 60T change pressure between a plurality of opposed bodies, that is, the fixing belt 21 and the pressure roller 22 pressed against the fixing belt 21. Alternatively, instead of the fixing belt 21 and the pressure roller 22, the pressure adjusters 60, 60S, and 60T may be connected to a plurality of components pressed against each other as long as pressure between the plurality of components is adjusted by rotating the cam 61 in contact with a cam rest (e.g., the roller 56).

For example, the pressure adjusters 60, 60S, and 60T may change pressure between the secondary transfer roller 36 and the secondary transfer backup roller 32 depicted in FIG. 1. As thick paper enters the secondary transfer nip formed between the secondary transfer roller 36 and the secondary transfer backup roller 32 via the intermediate transfer belt 30, the thick paper increases load imposed on the secondary transfer backup roller 32 substantially, decreasing the rotation speed of the intermediate transfer belt 30 rotating in the rotation direction R1 and therefore varying the rotation speed of the intermediate transfer belt 30. To address this circumstance, pressure exerted by the secondary transfer roller 36 may be decreased when the thick paper enters the secondary transfer nip. If a cam is used to change pressure exerted by the secondary transfer roller 36, the pressure adjusters 60, 60S, and 60T prevent noise that may be produced by the cam.

According to the example embodiments described above, the pressure adjusters 60, 60S, and 60T are installed in the image forming apparatus 1 that forms an image on a recording medium by electrophotography. Alternatively, the pressure adjusters 60, 60S, and 60T may be installed in an image forming apparatus employing other image forming method such as an inkjet method.

A description is provided of advantages of the pressure adjusters 60, 60S, and 60T.

As shown in FIGS. 4, 7, and 9, the pressure adjusters 60, 60S, and 60T include the cam 61 and the roller 56 serving as a cam rest contacting the cam 61. The cam 61 rotates to change pressure between a plurality of opposed bodies (e.g., the fixing belt 21 and the pressure roller 22) pressed against each other. The cam 61 has the top dead center X on the outer circumferential surface of the cam 61 that is distanced farthest from the rotation axis (e.g., the shaft 62) of the cam 61. The pressure adjusters 60, 60S, and 60T further include a cam regulation assembly (e.g., the cam regulation assemblies 70, 70S, and 70T) that regulates rotation of the cam 61 at least when the top dead center X of the cam 61 passes the contact position where the cam 61 contacts the roller 56.

Since the cam regulation assembly regulates rotation of the cam 61 at least when the top dead center X of the cam 61 passes the contact position where the cam 61 contacts the roller 56, the cam regulation assembly suppresses increase in the rotation speed of the cam 61 immediately after the top dead center X of the cam 61 passes the contact position. Accordingly, the cam regulation assembly prevents the cam 61 from separating from the roller 56. Consequently, the cam regulation assembly prevents noise (e.g., collision sound) that may be produced as the cam 61 comes into contact with the roller 56.

According to the example embodiments described above, the fixing belt 21 serves as a fixing rotary body. Alternatively, an endless film, a fixing roller, or the like may be used as a fixing rotary body. Further, the pressure roller 22 serves as a pressing rotary body. Alternatively, a pressing belt or the like may be used as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A pressure adjuster for changing pressure between a plurality of opposed bodies pressed against each other, the pressure adjuster comprising:

a cam rotatable in a given direction of rotation and having a top dead center on an outer circumferential surface thereof that is distanced farthest from a rotation axis of the cam;

a driver connected to the cam to drive and rotate the cam;

a cam rest contacting the cam and connected to one of the plurality of opposed bodies; and a cam regulation assembly connected to the cam to regulate rotation of the cam at least when the top dead center of the cam passes a contact position where the cam contacts the cam rest, wherein the cam regulation assembly rotates in accordance with rotation of the cam; and wherein one of the cam and the cam regulation assembly contacts the cam rest throughout a full revolution of the cam.

2. The pressure adjuster according to claim 1, wherein the cam regulation assembly includes a cam regulator contacting the cam and the cam rest to press against the cam rest to regulate rotation of the cam.

3. The pressure adjuster according to claim 2, wherein one of the cam regulator and the cam rest is made of an elastic body.

4. The pressure adjuster according to claim 3, wherein the one of the cam regulator and the cam rest made of the elastic body elastically deforms and contacts another one of the cam regulator and the cam rest at least when the top dead center of the cam passes the contact position where the cam contacts the cam rest.

5. The pressure adjuster according to claim 3, wherein the cam regulator projects beyond the outer circumferential surface of the cam radially at least in a circumferential span spanning from the top dead center of the cam to a vicinity of the top dead center of the cam in a direction counter to the given direction of rotation of the cam.

6. The pressure adjuster according to claim 3, wherein the cam regulator is eccentric and includes an increased radius portion to come into contact with the cam rest when the top dead center of the cam passes the contact position where the cam contacts the cam rest.

7. The pressure adjuster according to claim 1, wherein the cam regulation assembly includes:

a cam regulator contacting the cam and the cam rest; and an abutment pressed against the cam regulator to regulate rotation of the cam through the cam regulator.

8. The pressure adjuster according to claim 7, wherein the cam regulator rotates in accordance with rotation of the cam.

9. The pressure adjuster according to claim 7, wherein one of the cam regulator and the abutment is made of an elastic body.

10. The pressure adjuster according to claim 9, wherein the one of the cam regulator and the abutment made of the elastic body elastically deforms and contacts another one of the cam regulator and the abutment at least when the top dead center of the cam passes the contact position where the cam contacts the cam rest.

11. The pressure adjuster according to claim 9, wherein the cam regulator is eccentric and includes an increased radius portion to come into contact with the abutment when the top dead center of the cam passes the contact position where the cam contacts the cam rest.

12. The pressure adjuster according to claim 7, wherein the cam rest includes a roller and the abutment includes a rotor.

13. The pressure adjuster according to claim 1, wherein the cam regulation assembly includes an oil damper connected to the cam to regulate rotation of the cam.

14. The pressure adjuster according to claim 13, wherein the torque limiter allows rotation of the cam when a torque transmitted from the driver is greater than a preset value and regulates rotation of the cam when the torque transmitted from the driver is smaller than the preset value.

15. The pressure adjuster according to claim 14, wherein the preset value is smaller than the torque transmitted from the driver and greater than a torque that facilitates rotation of the cam in the given direction of rotation when the top dead center of the cam passes the contact position where the cam contacts the cam rest.

16. The pressure adjuster according to claim 13, further comprising a one-way clutch interposed between the driver and the torque limiter, wherein the driver rotates forward to rotate the cam and backward to rotate a component other than the cam, wherein, when the driver rotates forward to rotate the cam, the one-way clutch transmits a driving force from the driver to the torque limiter, and wherein, when the driver rotates backward to rotate the component other than the cam, the one-way clutch does not transmit the driving force from the driver to the torque limiter.

17. The pressure adjuster according to claim 1, wherein the cam regulator adjoins the cam.

18. An image forming apparatus comprising the pressure adjuster according to claim 1.

19. The pressure adjuster according to claim 1, wherein the cam regulation assembly includes a torque limiter connected to the cam to regulate rotation of the cam.

20. A fixing device comprising:

a fixing rotary body rotatable in a given direction of rotation;

a heater disposed opposite and heating the fixing rotary body;

a pressing rotary body pressed against the fixing rotary body to form a fixing nip therebetween;

a pressurization assembly to press the pressing rotary body against the fixing rotary body; and a pressure adjuster contacting the pressurization assembly to change pressure between the pressing rotary body and the fixing rotary body, the pressure adjuster comprising:

a cam rotatable in a given direction of rotation and having a top dead center on an outer circumferential surface thereof that is distanced farthest from a rotation axis of the cam;

a driver connected to the cam to drive and rotate the cam;

a cam rest contacting the cam and connected to the pressurization assembly; and a cam regulation assembly connected to the cam to regulate rotation of the cam at least when the top dead center of the cam passes a contact position where the cam contacts the cam rest, wherein the cam regulation assembly rotates in accordance with rotation of the cam; and wherein one of the cam and the cam regulation assembly contacts the cam rest throughout a full revolution of the cam.

* * * * *